US005325779A

United States Patent [19]

Ebina

[11] Patent Number: 5,325,779

[45] Date of Patent: Jul. 5, 1994

[54] PRINTING CYLINDER/ROLLER CLEANING APPARATUS FOR PRINTING PRESS

[75] Inventor: Toshihiko Ebina, Ibaraki, Japan

[73] Assignee: Komori Corporation, Tokyo, Japan

[21] Appl. No.: 7,481

[22] Filed: Jan. 22, 1993

[30] Foreign Application Priority Data

Jan. 27, 1992 [JP] Japan ..... 4-34052

[51] Int. Cl.[5] ..... B41K 35/00

[52] U.S. Cl. ..... 101/423; 101/425

[58] Field of Search ..... 101/423, 424, 425

[56] References Cited

U.S. PATENT DOCUMENTS

| | | | |
|---|---|---|---|
| 811,920 | 1/1904 | Hinchman et al. | 400/295.2 |
| 2,525,982 | 4/1948 | Wescott | 101/425 |
| 3,241,481 | 8/1964 | Gopperton | 101/383 |
| 4,058,059 | 11/1977 | Moestue | 101/425 |
| 5,150,650 | 9/1992 | Murakami | 101/423 |

FOREIGN PATENT DOCUMENTS 220349 1/1990 Japan .

*Primary Examiner*—Edgar S. Burr
*Assistant Examiner*—Anthony H. Nguyen
*Attorney, Agent, or Firm*—Blakely, Sokoloff, Taylor & Zafman

[57] ABSTRACT

A printing cylinder/roller cleaning apparatus for a printing press includes a cleaning cloth, a take-up shaft, a supply shaft, a ratchet wheel, a lock member, a swing lever, a one-way clutch, and an air cylinder. The cleaning cloth is pressed against a circumferential surface of a rotating printing cylinder/roller. The take-up shaft takes up the cleaning cloth. The supply shaft supplies the cleaning cloth. The ratchet wheel is coaxially mounted on the supply shaft. The lock lever is engaged with the ratchet wheel when the cleaning cloth is not taken up. The swing lever is coaxially mounted on the take-up shaft and rotated to actuate the lock lever, thereby releasing engagement between the ratchet wheel and the lock lever. The one-way clutch connects the take-up shaft with the swing lever only in a direction to take up the cleaning cloth. The air cylinder pivots the swing lever in response to a cleaning operation of the printing cylinder/roller.

5 Claims, 2 Drawing Sheets

PRINTING CYLINDER/ROLLER CLEANING APPARATUS FOR PRINTING PRESS

BACKGROUND OF THE INVENTION

The present invention relates to a printing cylinder/-roller cleaning apparatus for a printing press, which cleans the circumferential surface of a printing cylinder, e.g., a blanket cylinder, an impression cylinder, or a transfer cylinder, and the circumferential surface of a roller, e.g., a form roller or a vibrating roller.

Generally, a printing cylinder/roller cleaning apparatus of this type has a cleaning cloth take-up mechanism comprising a pair of rotatably supported roller-shaped cloth guides pressed against the circumferential surface of a printing cylinder/roller through a cleaning cloth, a supply shaft for supplying the cleaning cloth to the cloth guides, and a take-up shaft for taking up the cleaning cloth supplied from the supply shaft. The cleaning cloth is pressed against the circumferential surface of the printing cylinder/roller by intermittently taking up the cleaning cloth on the take-up shaft from the supply shaft, and the residue, e.g., ink dust or paper dust on the circumferential surface of the printing cylinder/roller is wiped with the cleaning cloth, thereby cleaning the circumferential surface of the printing cylinder/roller. In this case, when the cleaning cloth is taken up in the downstream side of the printing cylinder/roller, the cleaning cloth can be undesirably caught in the printing cylinder/roller. Hence, the supply shaft must be provided with a countermeasure so that the cleaning cloth will not be pulled unless the cleaning cloth is taken up.

An example of an apparatus provided with such a countermeasure is a cylinder cleaning apparatus disclosed in Japanese Patent Laid-Open No. 2-20349. In the cylinder cleaning apparatus disclosed in this official gazette, a rotation stop mechanism comprising a ratchet wheel mounted on the shaft end of a supply shaft, a ratchet to be engaged with this ratchet wheel, an air cylinder for engaging and disengaging the ratchet with and from the ratchet wheel, and a spring for biasing the ratchet away from the ratchet wheel is provided to the supply shaft. When the cleaning cloth is to be taken up on the take-up shaft, while the ratchet is separated from the ratchet wheel by the biasing force of the spring, the take-up shaft is driven by a take-up driving unit to take up the cleaning cloth. Unless the cleaning cloth is to be taken up, the ratchet is engaged with the ratchet wheel against the biasing force of the spring by the operation of the air cylinder as the driving unit of the rotation stop mechanism, so that rotation of the supply shaft in the supply direction is prohibited, thereby preventing the cleaning cloth to be pulled out.

However, in the conventional cylinder cleaning apparatus described above, the driving unit for driving the rotation stop mechanism comprising the air cylinder is required in addition to the take-up driving unit for the take-up shaft. In addition, since take-up driving of the take-up shaft and rotation regulation release of the supply shaft must be performed almost simultaneously, when the take-up driving mechanism and the rotation stop mechanism respectively having a separate driving means are to be interlocked, the entire apparatus is increased in size, and the operation becomes complicated, so that a smooth operation cannot be obtained.

SUMMARY OF THE INVENTION

It is an object of the present invention to provide a printing cylinder/roller cleaning apparatus for a printing press, which can be entirely decreased in size.

It is another object of the present invention to provide a printing cylinder/roller cleaning apparatus for a printing press, in which a take-up operation and pull-out prevention of the cleaning cloth are smoothly interlocked.

In order to achieve the above objects, according to the present invention, there is provided a printing cylinder/roller cleaning apparatus for a printing press, comprising a cleaning cloth pressed against a circumferential surface of a rotating printing cylinder/roller, a take-up shaft for taking up the cleaning cloth, a supply shaft for supplying the cleaning cloth, a ratchet wheel coaxially mounted on the supply shaft, a lock member engaged with the ratchet wheel when the cleaning cloth is not taken up, an actuating member, coaxially mounted on the take-up shaft and rotated, for actuating the lock member, thereby releasing engagement between the ratchet wheel and the lock member, a first one-way clutch for connecting the take-up shaft with the actuating member only in a direction to take up the cleaning cloth, and driving means for pivoting the actuating member in response to a cleaning operation of the printing cylinder/roller.

DESCRIPTION OF THE PREFERRED EMBODIMENT

Figure 1A:
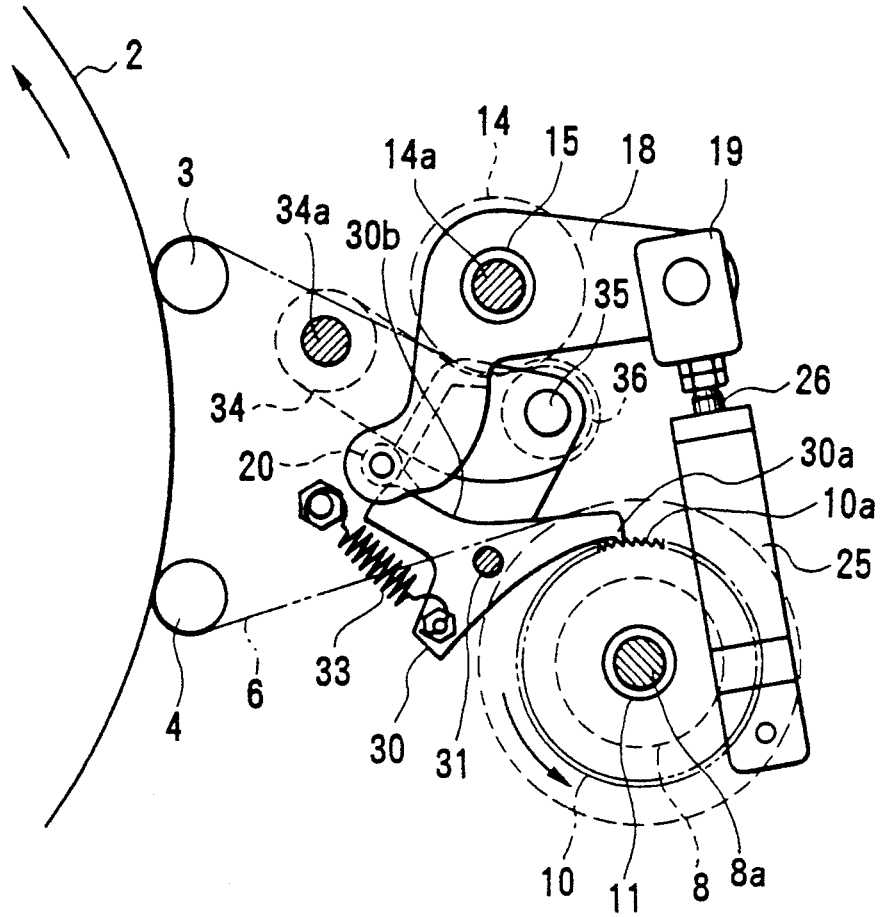
FIGS. 1A is a side view showing a printing cylinder/roller cleaning apparatus for a printing press according to an embodiment of the present invention.
Figure 1B:
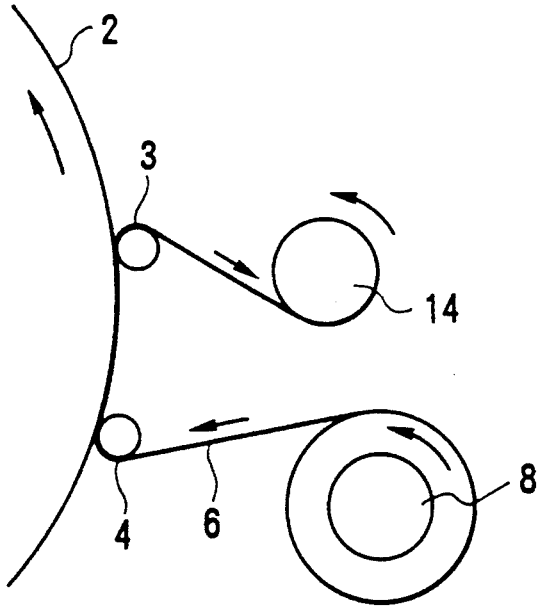
FIG. 1B is a view showing a state wherein a cleaning cloth is being taken up.
Figure 2A:
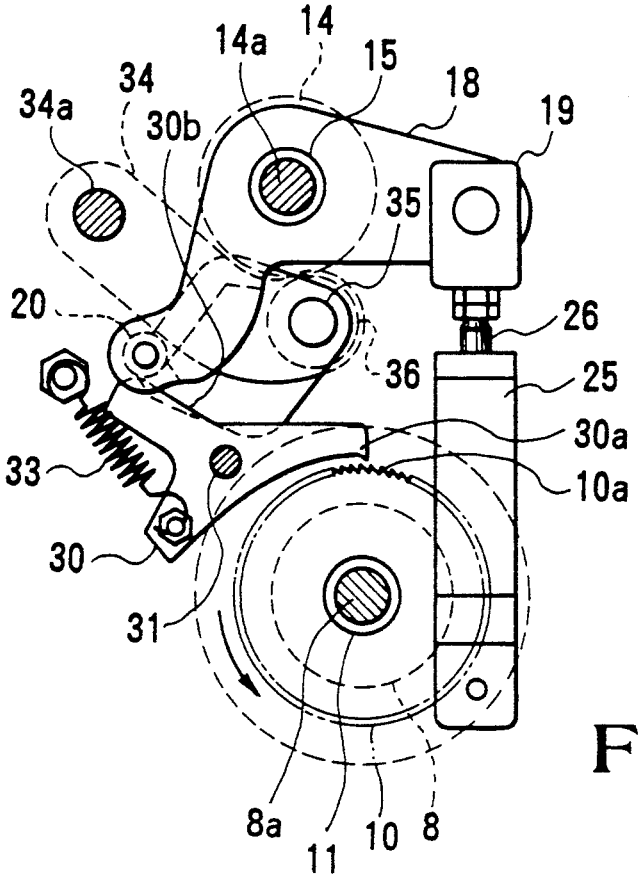
FIG. 2A is a view showing a state wherein the apparatus shown in FIG. 1A starts an operation of taking up the cleaning cloth.
Figure 2B:
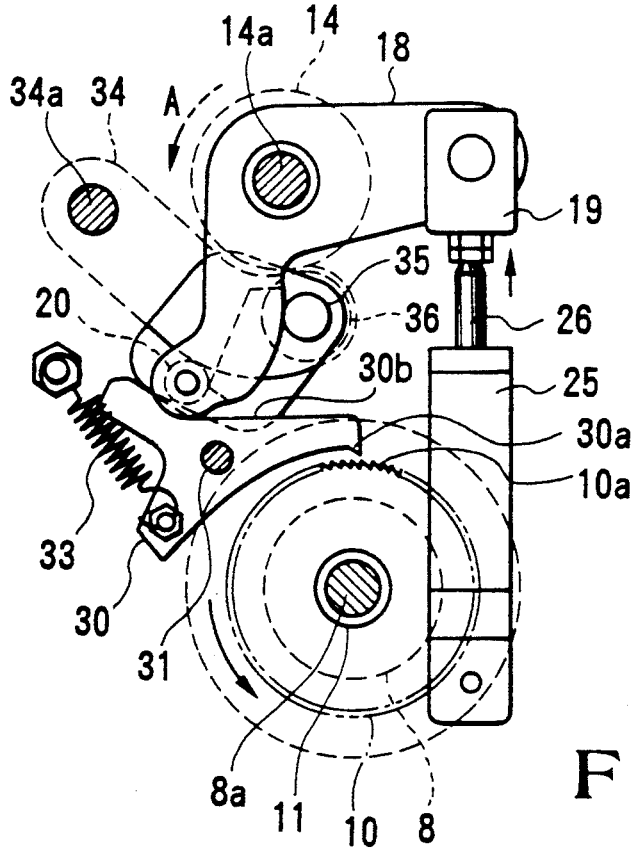
FIG. 2B is a view showing a state wherein the operation of taking up the cleaning cloth is completed.

A preferred embodiment of the present invention will be described with reference to the accompanying drawings. FIG. 1A shows a printing cylinder/roller cleaning apparatus for a printing press according to an embodiment of the present invention, FIG. 1B shows a state wherein a cleaning cloth is being taken up, FIG. 2A shows a state wherein an operation of taking up the cleaning cloth is started, and FIG. 2B shows a state wherein the operation of taking up the cleaning cloth is completed. Referring to FIGS. 1A to 2B, reference numeral 2 denotes a blanket cylinder pressed against an impression cylinder (not shown). Roller-shaped cloth guides 3 and 4 rotatably supported between frames (not shown) are pressed against the circumferential surface of the blanket cylinder 2. A belt-like cleaning cloth 6 extends between the cloth guides 3 and 4 to be pressed against the circumferential surface of the blanket cylinder 2. The cleaning cloth 6 is supplied from a cloth supply shaft 8 and taken up by a take-up shaft 14 driven by a take-up mechanism (not shown).

Reference numeral 10 denotes a ratchet wheel having a circumferential surface formed with teeth 10*a* and coaxially mounted on a shaft 8*a* of the supply shaft 8. The ratchet wheel 10 is connected to the supply roller 8 through a one-way clutch 11 so that when the ratchet wheel 10 is fixed, rotation of the supply roller 8 in a direction to supply the cleaning cloth 6 is prohibited. An L-shaped swing lever 18 is swingably supported by a shaft 14*a* of the take-up roller 14 as the swing shaft. The take-up roller 14 is connected to the swing lever 18 through a one-way clutch 15 so that the take-up roller 14 is rotatable only in a direction to take up the cleaning cloth 6.

An abutting block 19 is mounted on one end of the swing lever 18, and a roller 20 is provided on a rear surface of the other end of the swing lever 18. The abutting block 19 is coupled to the distal end of a rod 26 of an air cylinder 25 serving as an actuator. The swing lever 18 is swung about the shaft 14*a* by the rod 26 moving forward/backward from/into the air cylinder 25.

Reference numeral 30 denotes a substantially T-shaped lock lever supported to be swingable about a shaft 31. The lock lever 30 has one end provided with a ratchet 30*a*. The ratchet 30*a* is engaged with the teeth 10*a* of the ratchet wheel 10 to prohibit rotation of the ratchet wheel 10 in a direction to supply the cleaning cloth 6, i.e., counterclockwise in FIG. 1A. A cam surface 30*b* on which the roller 20 of the swing lever 18 slides is formed on the upper end face of the lock lever 30. The lock lever 30 is imparted with a swing habit by a compression spring 33 clockwise in FIG. 1A, i.e., in a direction with which its ratchet 30*a* is engaged with one of the teeth 10*a* of the ratchet wheel 10.

Reference numeral 34 denotes a V-shaped swing lever 34 swingable about its shaft 34*a*. A stopper pin 35 and a roller 36 for regulating the swing amount of the swing lever 18 are axially mounted on the swing end of the swing lever 34. The swing lever 34 is always imparted with a swing habit counterclockwise so that the roller 36 is abutted against the circumferential surface of the take-up roller 14. When the take-up diameter of the take-up roller 14 is increased, the swing lever 34 is gradually moved against the swing habit, and accordingly the stopper pin 35 is also moved clockwise. Then, the counterclockwise swing amount of the swing lever 18 abutted against the stopper pin 35 is regulated to be small, so that the take-up amount of the cleaning cloth 6 defined by the swing amount is adjusted almost at a constant value. That is, a predetermined length of the cleaning cloth 6 can be constantly taken up by one take-up operation regardless of the take-up diameter of the take-up roller 14.

The operation of this printing cylinder/roller will be described. During cleaning of the blanket cylinder 2, the air cylinder 25 is actuated to move the rod 26 forward, so that a soiled portion of the cleaning cloth 6 is taken up and a clean portion of the cleaning cloth 6 is supplied through the cloth guides 3 and 4. When the rod 26 is moved forward, the swing lever 18 swings counterclockwise about the shaft 14*a*. At this time, since the swing lever 18 is coupled to the take-up shaft 14 through the one-way clutch 15 so that the take-up roller 14 is rotatable only counterclockwise, the cleaning cloth 6 will not adhesively attach to an ink tack or the like and be pulled out from the take-up shaft 14 to the blanket cylinder 2.

When the swing lever 18 swings counterclockwise, the roller 20 slides on the cam surface 30*b* of the lock lever 30 from the state shown in FIG. 1A, and swings the lock lever 30 counterclockwise against the biasing force of the compression spring 33. Hence, as shown in FIG. 2A, the ratchet 30*a* is separated from the corresponding one of the teeth 10*a* of the ratchet wheel 10 to release engagement between the ratchet 30*a* and the corresponding one of the teeth 10*a*, and the ratchet wheel 10 is released and set rotatable.

The supply roller 8 is connected to the ratchet wheel 10 through the one-way clutch 11 so that the supply roller 8 will not rotate counterclockwise. When the ratchet 30*a* and the corresponding one of the teeth 10*a* are engaged with each other, the cleaning cloth 6 will not be pulled out. As described above, when engagement between the ratchet 30*a* and the corresponding one of the teeth 10*a* is released, the supply roller 8 is rotated counterclockwise, together with the ratchet wheel 10, about the shaft 8*a*. Thus, a clean portion of the cleaning cloth 6 is pulled out, supplied, and taken up by the take-up roller 14.

As the rod 26 is moved forward, when the swing lever 18 is abutted against the stopper pin 35, as shown in FIG. 2B, rotation of the supply roller 8 connected to the swing lever 18 is stopped, and the take-up operation of the cleaning cloth 6 is completed. Thereafter, when the rod 26 starts to be moved backward, the swing lever 18 swings clockwise, and accordingly the lock lever 30 is also caused to start swinging clockwise by the restoring force of the compression spring 33. When the roller 20 is disengaged from the cam surface 30*b*, the ratchet 30*a* of the lock lever 30 is engaged with the corresponding one of the teeth 10*a* of the ratchet wheel 10, and the supply shaft 8 is also locked by the one-way clutch 11 which is connected to the ratchet wheel 10 such that its counterclockwise rotation is disabled. Hence, the cleaning cloth 6 will not be pulled out from the supply roller 8 unless it is taken up. This operation is repeated by intermittently moving the rod 26 forward/backward, so that the cleaning cloth 6 is intermittently taken up.

In this embodiment, the printing cylinder/roller to be cleaned with the cleaning cloth 6 is the blanket cylinder 2. However, the present invention is not limited to this, and can naturally be applied to any other printing cylinder or a rotating roller. The cleaning cloth 6 is pressed against the circumferential surface of the blanket cylinder 2 by the pair of roll-shaped cloth guides 3 and 4. However, the present invention is not limited to this, and various design modifications can be made. The swing lever 18 and the lock lever 30 are interlocked with each other through the roller 20 and the cam surface 30*b*. However, the present invention is not limited to this, and the swing lever 18 and the lock lever 30 may be coupled through a link mechanism. Alternatively, in place of the swing lever 18, for example, a pinion may be axially mounted on the take-up roller 14, the rod 26 may be provided with a rack to be meshed with the pinion, and the lock lever 30 may be directly coupled to the rod 26. In this case, the pinion and the lock lever 30 need not be swingable, and the compression spring 33 for biasing the lock lever 30 can be eliminated. In place of the air cylinder 25, an actuator may be adopted as the actuator, as a matter of course. The ratchet wheel 10 is coupled to the supply roller 8 through the one-way clutch 11. However, it is apparent that a similar effect to this can be obtained even by integrally coupling the ratchet wheel 10 with the supply roller 8.

As has been described above, according to the present invention, since the air cylinder serving as the driving means of the take-up shaft is used also as the driving means for releasing rotation regulation of the supply shaft, thus eliminating an exclusive driving means, the apparatus can be reduced in size. Furthermore, since the supply and take-up operations of the cleaning cloth can be performed in an interlocked manner by the operation of a single driving means, the smooth take-up operation and pull-out prevention of the cleaning cloth can be obtained.

What is claimed is:

1. A printing cylinder/roller cleaning apparatus for a printing press, comprising a cleaning cloth;

a take-up shaft for taking up said cleaning cloth;

a supply shaft for supplying said cleaning cloth;

a ratchet wheel coaxially mounted on said supply shaft;

a lock member with a cam surface, engaged with said ratchet wheel when said cleaning cloth is not taken up;

an actuating member having a swing lever coaxially mounted on said take-up shaft, said swing level having a swing end, and said swing end of the swing lever slides on the cam surface of said lock member, thereby releasing engagement between said ratchet wheel and said lock member;

a first one-way clutch for connecting said take-up shaft with said actuating member only in a direction to take up said cleaning cloth; and driving means for pivoting said actuating member in response to a cleaning operation of the printing cylinder/roller.

2. An apparatus according to claim 1, further comprising a stop member for adjusting a swing amount of said swing lever in accordance with a take-up diameter of said take-up shaft, and wherein said take-up shaft takes up a substantially constant amount of cleaning cloth in accordance with the swing amount of said swing lever regardless of the take-up diameter.

3. An apparatus according to claim 1, wherein said lock member comprises a lever having a ratchet engaged with said ratchet wheel.

4. An apparatus according to claim 1, wherein said driving means comprises an air cylinder having a rod coupled to said actuating member, and said actuating member is rotated forward and backward by a reciprocal movement of said rod.

5. An apparatus according to claim 1, further comprising a second one-way clutch for connecting said supply shaft with said ratchet wheel only in a direction to supply said cleaning cloth.

* * * * *